US010384175B2

(12) United States Patent
Hatch et al.

(10) Patent No.: US 10,384,175 B2
(45) Date of Patent: Aug. 20, 2019

(54) MIXING CHAMBER

(71) Applicants: BAKERY CONCEPTS INTERNATIONAL, LLC., Mechanicsburg, PA (US); STRATTON SALES AND SERVICE, INC., Salt Lake City, UT (US)

(72) Inventors: Brigham Hatch, Arimo, ID (US); Bryan Stratton, Woods Cross, UT (US)

(73) Assignees: BAKERY CONCEPTS INTERNATIONAL, LLC, Mechanicsburg, PA (US); STRATTON SALES AND SERVICES, INC., Salt Lake City, UT (US)

( * ) Notice: Subject to any disclaimer, the term of this patent is extended or adjusted under 35 U.S.C. 154(b) by 0 days.

(21) Appl. No.: 16/260,463

(22) Filed: Jan. 29, 2019

(65) Prior Publication Data

US 2019/0151809 A1 May 23, 2019

Related U.S. Application Data

(63) Continuation of application No. 15/532,503, filed as application No. PCT/US2015/063704 on Dec. 3, 2015, now Pat. No. 10,195,572.

(Continued)

(51) Int. Cl.

| | |
|---|---|
| ***B01F 5/00*** | (2006.01) |
| ***B01F 5/20*** | (2006.01) |
| ***B01F 3/12*** | (2006.01) |
| ***B01F 15/00*** | (2006.01) |
| ***B01F 15/02*** | (2006.01) |

(52) U.S. Cl.

CPC ..... *B01F 5/205* (2013.01); *B01F 3/1228* (2013.01); *B01F 15/00428* (2013.01); *B01F 15/0261* (2013.01); *B01F 2215/0011* (2013.01); *B01F 2215/0422* (2013.01)

(58) Field of Classification Search

CPC .. B01F 5/205; B01F 3/1228; B01F 15/00428; B01F 15/0261; B01F 2215/0011; B01F 2215/0422

See application file for complete search history.

(56) References Cited

U.S. PATENT DOCUMENTS

| | | | |
|---|---|---|---|
| 1,741,176 | A | 12/1929 | Wilder |
| 2,071,846 | A | 2/1937 | Lamb et al. |

(Continued)

FOREIGN PATENT DOCUMENTS

| | | | |
|---|---|---|---|
| DE | 202004018807 | U1 | 3/2005 |
| WO | 2010/040043 | A1 | 4/2010 |

*Primary Examiner* — Anshu Bhatia

(74) *Attorney, Agent, or Firm* — Volpe and Koenig, P.C.

(57) ABSTRACT

A mixing chamber for mixing a variety of dry ingredients with a liquid is disclosed. The mixing chamber has an accumulation chamber that evenly distributes ingredients as they pass a liquid spray nozzle, resulting in uniform hydration. The liquid may be sprayed at a variety of pressures to achieve varying levels of granule hydration to permit the manufacture of dough, batter, or other compositions. Even dry ingredients which are generally slow to absorb moisture may be rapidly and evenly hydrated without an excess of liquid. Process parameters, such as volume flow rate of the dry ingredients, can also be varied.

7 Claims, 6 Drawing Sheets

Related U.S. Application Data

(60) Provisional application No. 62/086,815, filed on Dec. 3, 2014.

(56) References Cited

U.S. PATENT DOCUMENTS

| | | | | |
|---|---|---|---|---|
| 3,879,021 | A | 4/1975 | Riley | |
| 4,369,689 | A * | 1/1983 | Donaghue | B01F 5/0256 118/303 |
| 6,517,232 | B1 | 2/2003 | Blue | |
| 7,332,190 | B2 | 2/2008 | Noll | |
| 2008/0144425 | A1 | 6/2008 | Etzenbach | |
| 2010/0226722 | A1 | 9/2010 | Walker | |
| 2011/0085407 | A1 | 4/2011 | Matsuda et al. | |
| 2013/0292598 | A1 | 11/2013 | Black et al. | |

* cited by examiner

MIXING CHAMBER

CROSS REFERENCE TO RELATED APPLICATION

This application is a continuation of U.S. patent application Ser. No. 15/532,503, which was filed Jun. 2, 2017, which claims the benefit of a 371 application PCT/US2015/063704, which was filed Dec. 3, 2015, which claims the benefit of U.S. Provisional Application No. 62/086,815, which was filed Dec. 3, 2014 and is incorporated herein by reference in its entirety.

FIELD OF INVENTION

The present disclosure relates generally to mixing chambers for hydrating dry granulated materials. More particularly, the invention relates to hydrating flour-like dry granulated materials in a consistent and uniform manner.

BACKGROUND

Dry ingredients mixing chambers for use in continuous flow processes are known from the prior art, and are often used in connection with large-scale production. One such mixing chamber is shown in U.S. Pat. No. 7,332,190.

Prior art mixing chambers fail to effectively mix a wide variety of dry ingredients at variable flow rates. The dry ingredients concentrate in some portions of the mixing chamber, resulting in inconsistent hydration of the dry ingredients. When dough is mixed in the prior art mixing chambers, the result is thicker dough farther from the spray, wet batter-like dough at the edges of the spray, and un-mixed liquid at the center of the spray. This unmixed liquid presents a problem because the machine operator has a difficult time assessing whether the dry ingredients have been properly hydrated. Certain food recipes require highly accurate hydration. Prior art mixing chamber designs make precise process control difficult.

Prior art mixing chambers also do not provide adequate protection from food contamination. Food safety and sanitation standards in the United States and other countries are stringent, and require regular cleaning to prevent bacterial growth on food production equipment. Prior art mixing chamber designs are difficult to clean and do not meet the most stringent food sanitation requirements.

Finally, prior art mixing chamber designs have limited adjustment of key process parameters such as liquid and dry ingredients flow rate to accommodate variations in the type of dry ingredients, their density, granulated particle size and desired hydration levels.

There exists a need for an improved mixing chamber that permits uniform hydration of a wide variety of dry ingredients.

SUMMARY

A mixing chamber for mixing dry ingredients with a liquid is disclosed. The mixing chamber allows the user to hydrate a variety of dry ingredients such as flour, bran, and whole seeds and incorporates a variety of process controls. The mixing chamber evenly distributes ingredients as they pass the liquid spray nozzle, resulting in uniform hydration. The liquid can be sprayed at a variety of pressures to achieve varying levels of granule hydration. Even dry ingredients that are generally slow to absorb moisture may be rapidly and evenly hydrated without an excess of liquid. Other process parameters such as volume flow rate of the dry ingredients can be varied to ensure optimum process control for all applications.

The disclosed mixing chamber is particularly useful for hydrating dry ingredients that do not absorb liquids quickly, such as bran, gluten, and fiber. In addition producing dough for human consumption, the mixing chamber is useful for all kinds of batters, including pancake, donut, muffin, crepe, sponge batters, and a variety of non-food ingredients.

BRIEF DESCRIPTION OF THE DRAWING(S)

FIG. 1 is a perspective view of the preferred embodiment of the mixing chamber.

FIG. 2, a side view of the mixing chamber of FIG. 1, illustrates the presentation of the dry ingredient to the liquid spray.

DETAILED DESCRIPTION OF THE PREFERRED EMBODIMENT(S)

Figure 1:
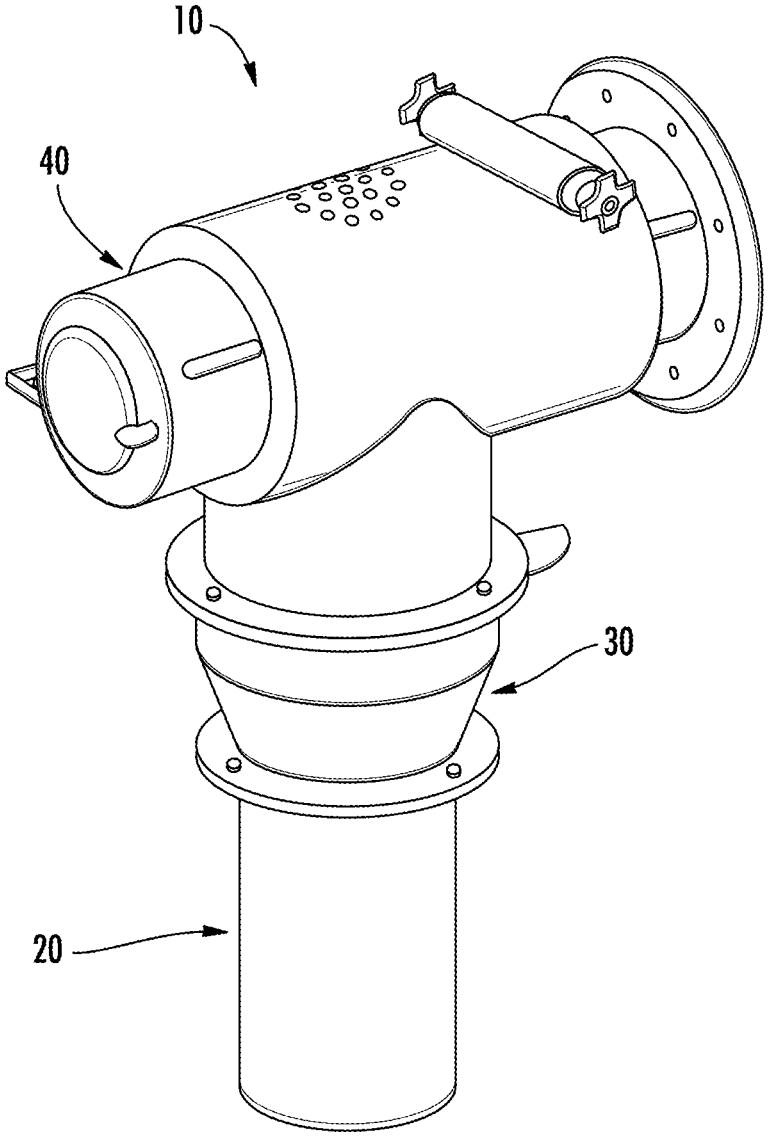
Figure 2:
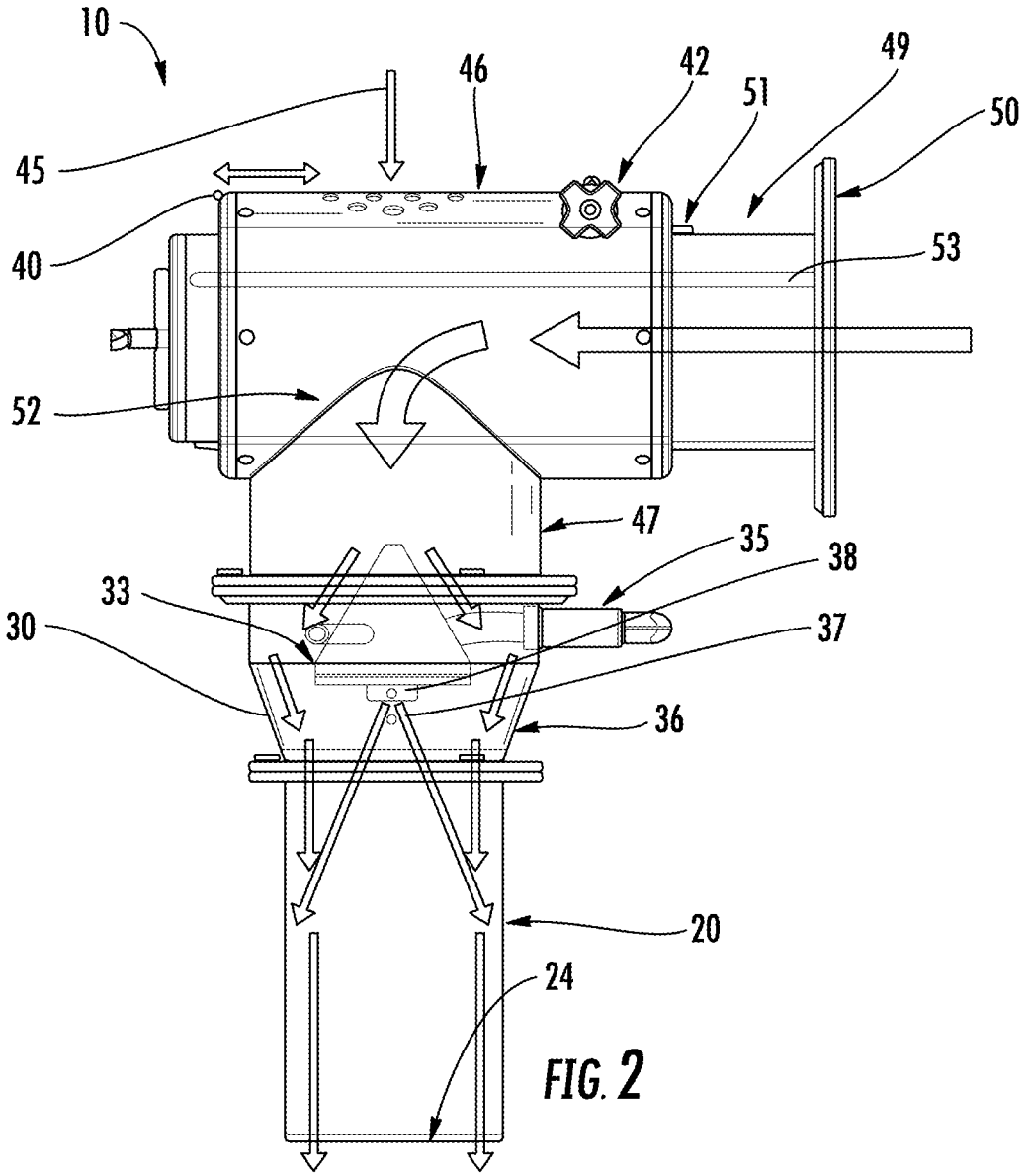

A preferred embodiment of the mixing chamber is shown in FIGS. 1 and 2. The mixing chamber 10 includes the dry ingredients metering inlet 40, the accumulation chamber 30, and the mixing tube 20. The ingredients enter the mixing chamber 10 through the dry ingredient metering inlet 40 and drop into the accumulation chamber 30 where they are dispersed prior to hydration. The ingredients are hydrated as they enter the mixing tube 20, and exit the bottom of the tube.

The mixing chamber's granule flow is shown in detail in FIG. 2, which is a right side view of a preferred embodiment. The mixing chamber 10 includes the dry ingredients metering inlet 40, which includes a flow rate adjustment knob 42 that moves the outer sleeve 46 with respect to the inner sleeve 49 via the adjustment rack 51, with the adjustment rack 51 attached to the inner sleeve 49. Sliding of the outer sleeve 46 and the inner sleeve 49 with respect to each other controls the flow rate of dry ingredients by opening and closing the orifice 52 as they pass into the accumulation chamber 30. This sliding relative to each other opens or closes a portion of orifice 52, which varies the size of orifice 52. The inner sleeve 49 is mounted to upstream equipment via the mounting flange 50. The dry ingredient metering inlet 40 includes air inlet holes 45 that permit air movement to avoid developing undesirable an vacuum due to the entry of the dry ingredients.

Once ingredients pass through the orifice 52, they can free fall in the metered dry ingredient tube 47 into the accumulation chamber 30. As the dry ingredients fall toward the accumulation chamber 30, they encounter the diverter 33, which is conical in this embodiment and tapered outwardly as it approaches the accumulation chamber 30.

By encountering the diverter 33, the ingredients are distributed into a uniform cone, or another shape corresponding to the diverter 33, that flows toward the outside of the accumulation chamber 30. The accumulation chamber 30 may include an accumulator neck down 36, which can be a tapered section of wall forming the accumulation chamber 30. In this configuration, the accumulator 36 has a taper that is opposite to the taper of the diverter 33. With this configuration, the ingredients contact the accumulator 36 and are redirected toward the center of the mixing tube 20. The result of this configuration is an even distribution of ingredients as they pass the liquid spray 37. The liquid spray 37 generated by the discharge spray nozzle 38 is directed downwardly against the falling dry ingredients as they exit the accumulation chamber 30 and enter the mixing tube 20. The liquid spray 37 hydrates the ingredients as they are passing through the mixing tube 20 by gravity.

Figure 3:
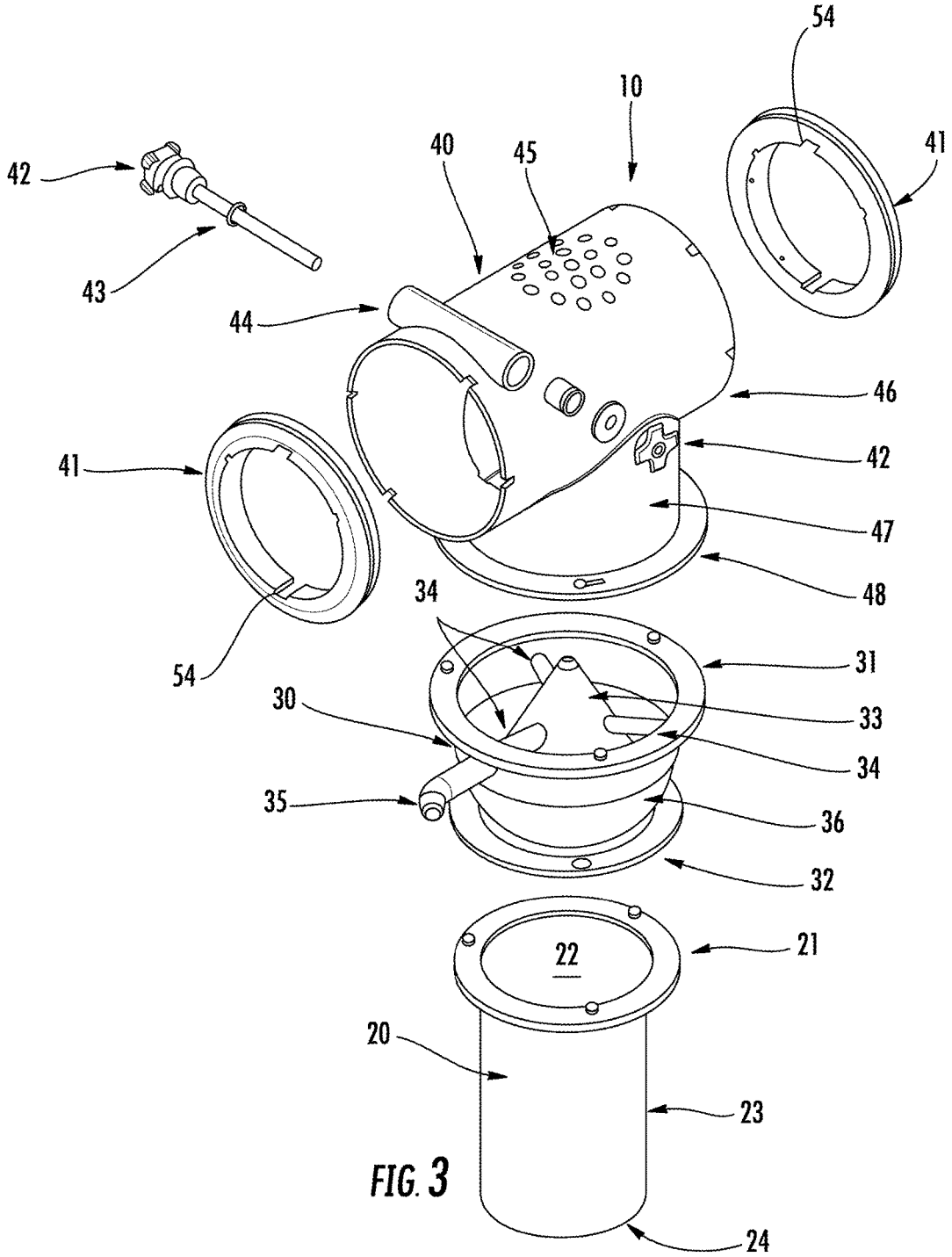
FIG. 3 is an exploded view of the mixing chamber of FIG. 1.

FIG. 3 is an exploded perspective view of the mixing chamber 10 in FIG. 1. The dry ingredients metering inlet 40 consists of an outer sleeve 46 and an inner sleeve 49, see FIG. 2. Guide bearings 41, provided in the outer sleeve 46, to permit the inner sleeve to slide along the guide bearings. The channels or groves 54 in guide bearings 41 cooperate with the ridges 53, see FIG. 2, to maintain the mixing tube's orientation and prevent rotation about the inner sleeve 49. Depending on the desired configuration, the locations of the channels and ridges can be reversed. As shown in FIG. 2, the knobs 42 are connected to a pinion 43, inside the adjustment housing 44, that cooperates with an adjustment rack 51, shown in FIG. 2, on the inner sleeve 49 to adjust the size of the orifice 52.

The air inlet holes 45 allow air to enter the dry ingredients metering inlet 40 to avoid an undesirable vacuum in the mixing chamber 10. The metered dry ingredients tube is attachable to the accumulation chamber 30 via the flange 48. The accumulation chamber 30 has a corresponding flange 31 which mates to flange 48.

FIG. 3 shows the dry ingredients diverter 33 positioned in the accumulation chamber 30. The diverter 33 is supported by nozzle supports 34. In some embodiments, one of the nozzle supports 34, identified at 35, functions as a part of the supply line for hydrating liquid to the spray nozzle 38, see FIGS. 2 and 3. The accumulator neck down 36 is shaped to redirect ingredients toward the center of the accumulation chamber 30 and into mixing tube 20. The mixing tube inlet 22 opens to the mixing tube body 23 where the ingredients from the accumulation chamber 30 are exposed to the high-pressure liquid spray 37. The ingredients then exit the mixing tube outlet 24 by gravity and ingredient flow. The mixing tube 20 and accumulation chamber 30 are connected by flanges 21 and 32.

Figure 4:
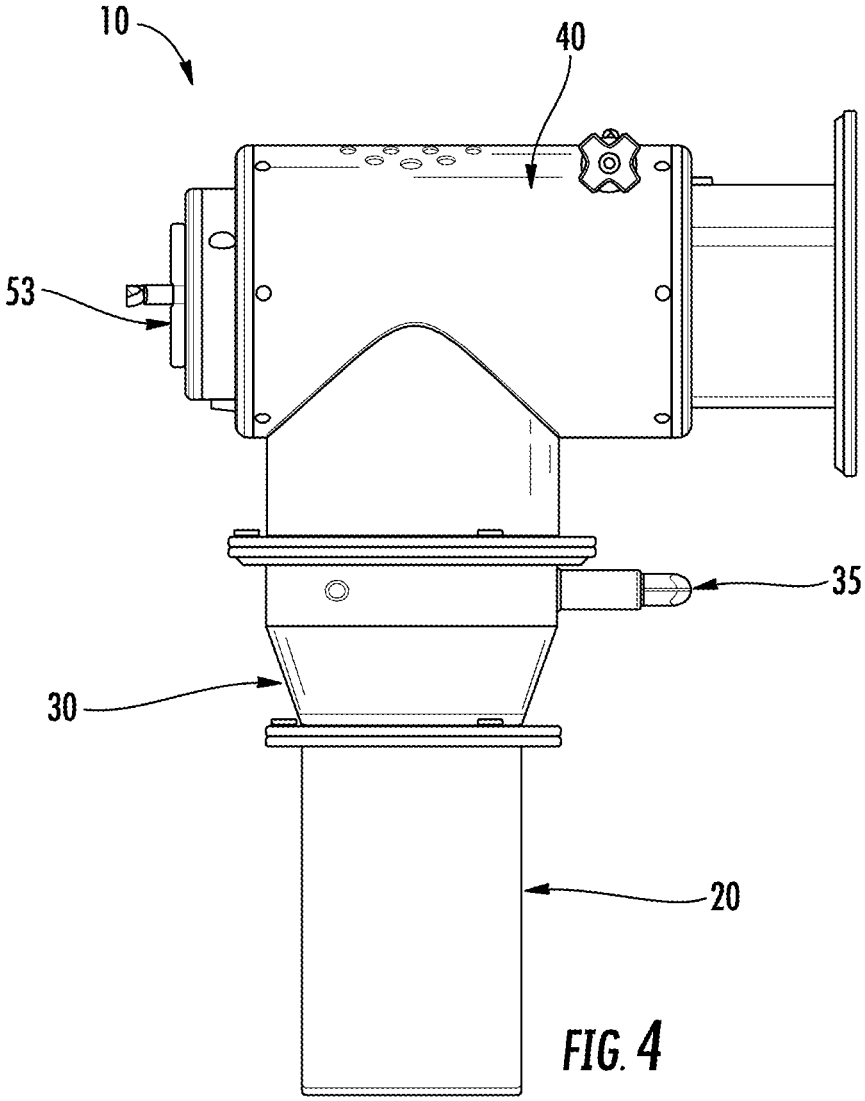
FIG. 4 is a right side view of the mixing chamber of FIG. 1.

FIG. 4 shows a right side view of the mixing chamber 10. Access cover 53, shown at the end of the dry ingredient metering inlet 40, permits cleaning and servicing of the assembly without complete disassembly. The other numbered components are as described above with the same numerals.

Figure 5:
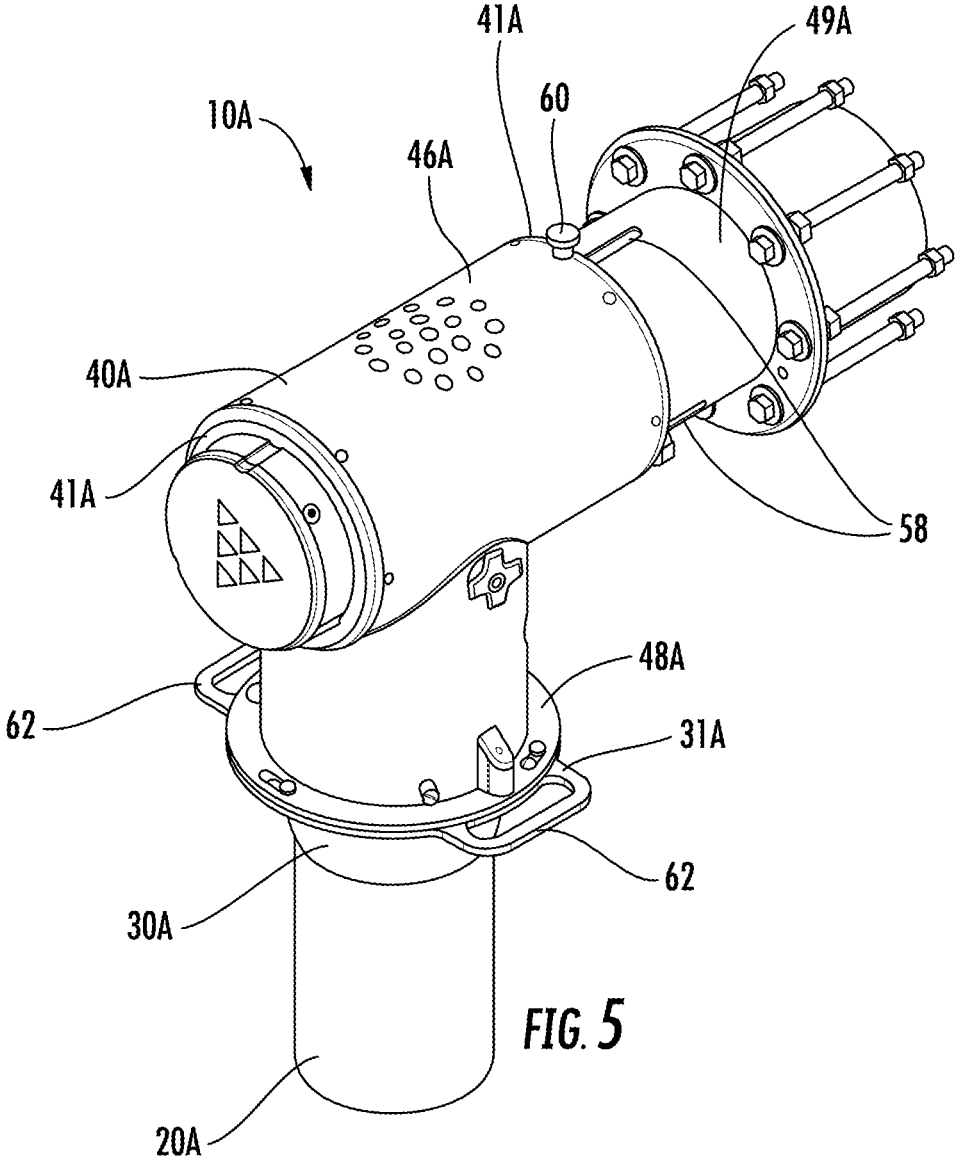
FIG. 5 is a perspective view of an alternative embodiment of the mixing chamber.
Figure 6:
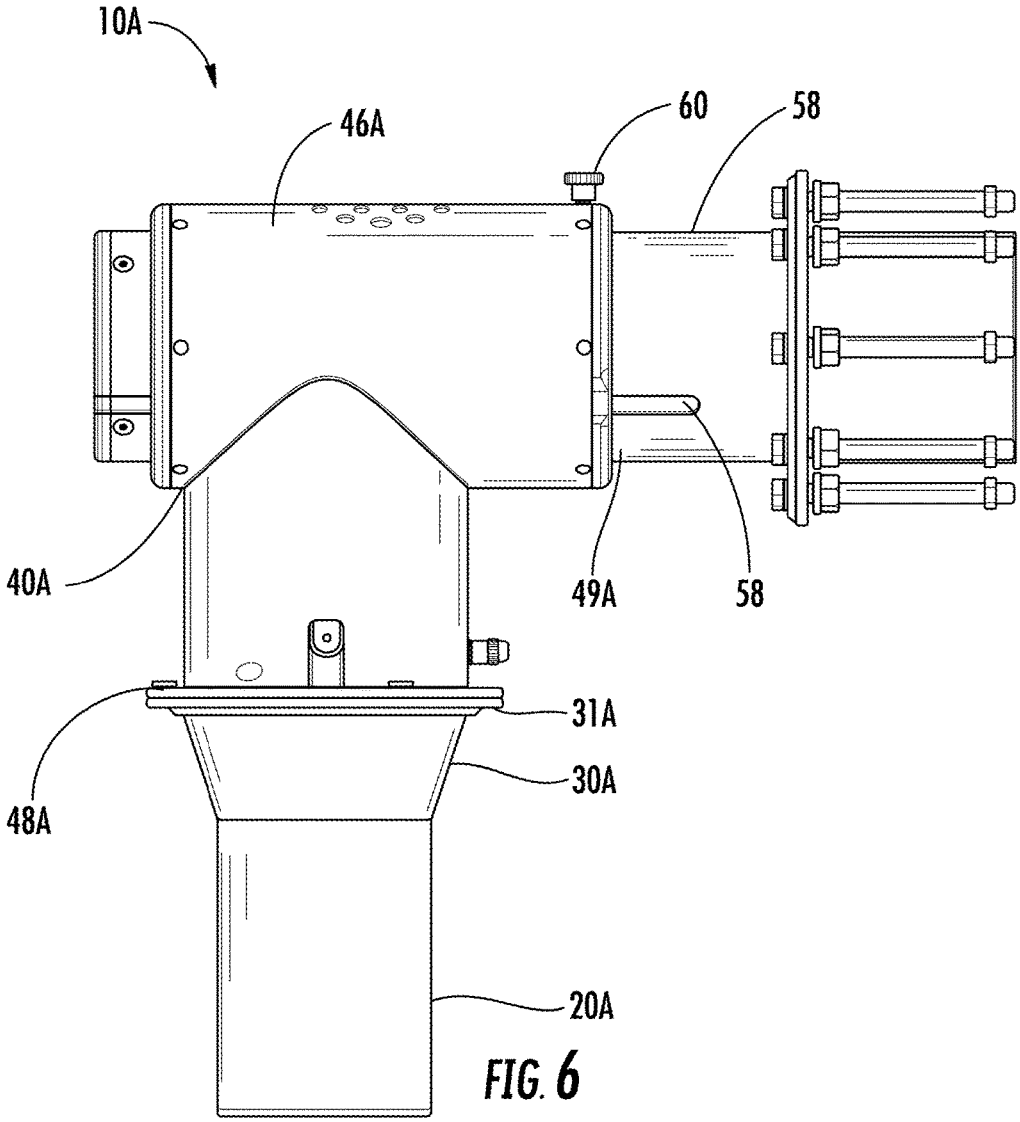
FIG. 6 is a right side view of the mixing chamber of FIG. 5.

FIGS. 5 and 6 show a mixing chamber 10A according to an alternative embodiment. The mixing chamber 10A includes the dry ingredients metering inlet 40A, the accumulation chamber 30A, and the mixing tube 20A, according to alternative configurations. The metering inlet 40A includes a plurality of channels or grooves 58 that allow for sliding movement between outer sleeve 46A and inner sleeve 49A to vary the orifice size within the metering inlet 40A. An locking adjustment knob 60 locks the sliding parts in the desired position. In this configuration, the locking adjustment knob 60 is a threaded in the outer sleeve 46A.

The accumulation chamber 30A and the mixing tube 20A function in substantially the same manner as the accumulation chamber 30 and the mixing tube 20, but may be of an alternative configuration. For example, the accumulation chamber 30A and the mixing tube 20A are directly connected (e.g., integrally formed), instead of being connected by one or more flanges. Further, the chamber inlet flange 31A is mounted at the top of the tapered portion of the accumulation chamber 30A. Additionally, chamber inlet flange 31A may include one or more handles 62 that are useful for aligning inlet flange 31A dry ingredient metering exit flange 48A.

A variety of liquids can used to hydrate the dry ingredients. The liquid is applied as a high pressure spray, which may have a pressure ranging between 10 bar (approximately 145 psi) and 300 bar (approximately 4,300 psi) so as to achieve optimum hydration. Different dry ingredients absorb moisture best at different pressures. For instance, wheat bran has low density and hydrates best at pressures between 20 bar (approximately 300 psi) and 69 bar (approximately 1,000 psi) while granulated white sugar hydrates best at 137 bar (approximately 2,000 psi). Wheat gluten is well hydrated at pressures exceeding 69 bar (approximately 1,000 psi), resulting in a mixed dough. However, wheat gluten does not absorb as much moisture at 20 bar (approximately 300 psi), which results in a homogenous liquid batter. A variety of characteristics can be obtained by adjusting the pressure.

The high pressure spray is directed downwardly inside of the tube at the dry ingredients in a conical pattern a liquid spray angle of less than 50 degrees. The spray causes a vacuum within the tube, which changes the ingredients' free fall pattern, and it helps to draw the ingredients down into the high pressure spray. This vacuum changes with liquid velocity, liquid volume, spray angle, and the area of the tube. Dry ingredients may vary widely in size and density, which will also change their free fall pattern. The diverter 33, which may take shapes other than conical, is designed to ensure that regardless of the exact dry ingredients to be hydrated, the diverter pattern will be consistently distributed into the spray pattern.

The volume flow rate of the dry ingredients is controlled through the dry ingredient metering inlet, which is located above the spray nozzle. Dry ingredients are introduced to the mixing chamber via an auger, screw, or other device known in the art. The mixture inlet assembly controls the flow rate of the dry ingredients by closing off a portion of the opening above the vertical tube. Air is allowed to flow into the vertical tube to help distribute the dry ingredients as they fall and are drawn in by the vacuum generated from the spray nozzle. This adjustment permits adjustment of the flow rate to ensure even distribution. If there is too much volume flow, there is a risk that the distribution of ingredients will be uneven and will not be uniformly hydrated. If there is too little volume flow, there will be excess liquid in the resulting mixture. Further, varying both the liquid spray pressure and the dry ingredient volume flow rate will allow changing the impact velocity of the liquid with the ingredients and change the hydration characteristics. Hydration levels between 40% and 359% liquid have been achieved with the mixing chamber, but results may vary based on the physical properties of the ingredients and the process parameters used.

What we claim is:

1. A mixing chamber for hydrating food ingredients, the mixing chamber comprising:

an adjustable ingredients inlet that delivers selected amounts of free falling ingredients to an accumulation chamber;

a diverter in the accumulation chamber that directs the ingredients outwardly toward an inwardly-tapered wall, wherein the diverter has an upper surface and a lower surface that lies in a plane spaced by a predetermined distance from the upper surface;

a liquid discharge nozzle that depends from the diverter and extends below the plane of the lower surface of the diverter and discharges a liquid spray that contacts the free falling ingredients after the ingredients pass through the plane of the lower surface of the diverter; and a mixing tube that receives the ingredients from the accumulation chamber.

2. The mixing chamber of claim 1, further comprising a liquid supply line that passes through the diverter and connects to the liquid discharge nozzle.

3. The mixing chamber of claim 1, wherein the diverter is held in the accumulation chamber by a plurality of supports.

4. The mixing chamber of claim 3, wherein at least one of the plurality of supports is a liquid supply line that connects to the liquid discharge nozzle.

5. The mixing chamber of claim 1, wherein the diverter is tapered outwardly from the upper surface to the lower surface.

6. An apparatus for receiving free-falling dry ingredients, hydrating the ingredients, and directing the hydrated ingredients to a mixing tube, the apparatus comprising:

a variable inlet opening for receiving the dry ingredients;

a first flange surrounding the inlet opening and configured to connect an accumulation chamber to the variable inlet;

a diverter in the accumulation chamber that directs the ingredients outwardly toward an inwardly-tapered wall configured to redirect the ingredients towards a center of the accumulation chamber, and a lower most edge of the diverter lies in a plane that is spaced from an upper most surface of the diverter;

a discharge nozzle that depends from the diverter, extends below the diverter's lower most edge, and discharges a pressurized liquid that hydrates the ingredients as the ingredients pass the lower most edge of the diverter; and, a mixing tube that receives the hydrated ingredients.

7. The accumulation chamber of claim 6, wherein the inwardly tapered wall is configured to redirect the ingredients as they pass the discharge nozzle.

* * * * *